United States Patent [19]

Scheffel

[11] 4,043,361

[45] Aug. 23, 1977

[54] APPARATUS TO DELIVER WEFT TO FLUID WEFT INSERTING MEANS

[76] Inventor: Walter Scheffel, Industriestr. 53, 8832 Weissenburg, Germany

[21] Appl. No.: 697,782

[22] Filed: June 21, 1976

Related U.S. Application Data

[62] Division of Ser. No. 430,303, Jan. 2, 1974, abandoned.

[30] Foreign Application Priority Data

| | | |
|---|---|---|
| Apr. 4, 1973 | Germany | 2316734 |
| June 2, 1973 | Germany | 2328135 |

[51] Int. Cl.[2] ..... D03D 47/34

[52] U.S. Cl. ..... 139/452; 139/435

[58] Field of Search ..... 139/429, 450, 452, 435; 66/125, 132; 226/195

[56] References Cited

U.S. PATENT DOCUMENTS

| | | | |
|---|---|---|---|
| 3,083,924 | 4/1963 | Vossen et al. | 66/132 |
| 3,280,853 | 10/1966 | Brown et al. | 139/452 |
| 3,455,341 | 7/1969 | Pfarrwaller et al. | 66/132 |
| 3,470,922 | 10/1969 | Senn | 139/452 |
| 3,759,455 | 9/1973 | Clemens | 66/132 |

*Primary Examiner*—Henry S. Jaudon
*Attorney, Agent, or Firm*—Walter Becker

[57] ABSTRACT

A weft transport apparatus for weaving machine operative to insert said weft by means of a fluid and comprising at least two co-axial mounted drums one of the drums is rotatably driven and the other said drums is stationarily mounted and co-operating guide means being operative to move the weft between the drums.

5 Claims, 8 Drawing Figures

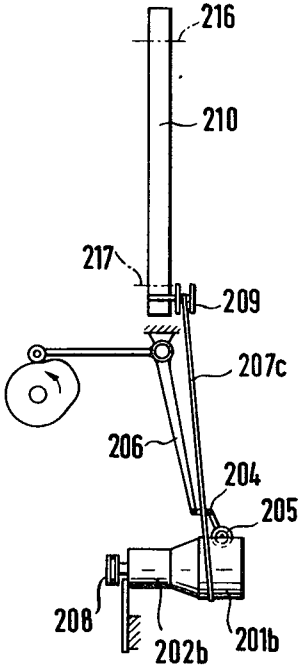
Fig. 6
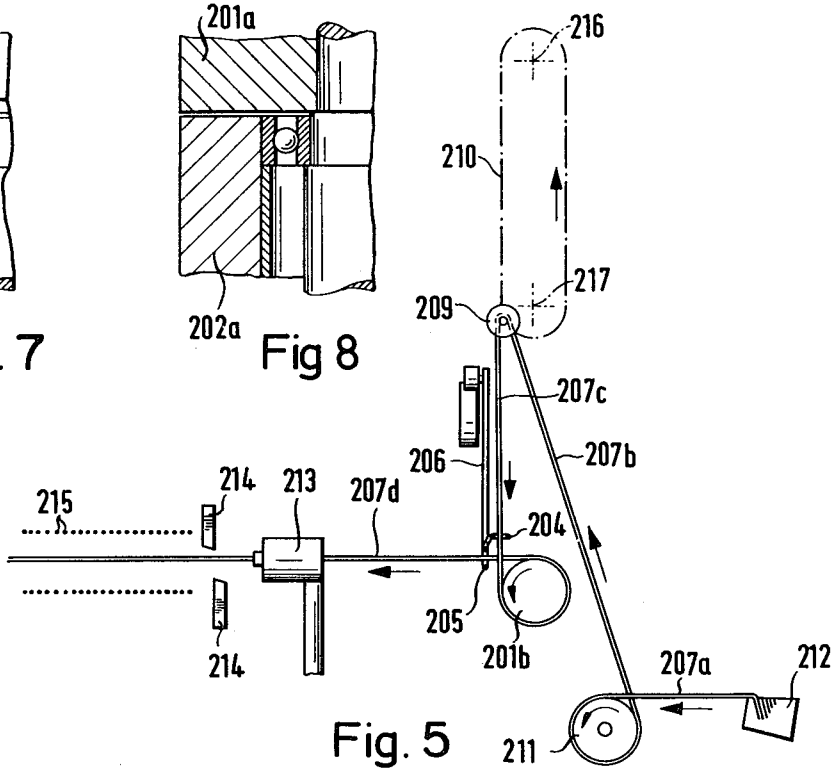
Fig. 5
Fig 8
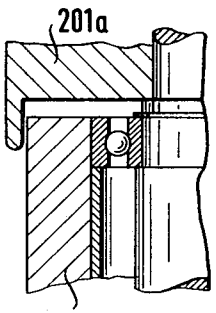
Fig. 7

APPARATUS TO DELIVER WEFT TO FLUID WEFT INSERTING MEANS

This is a division of co-pending application Ser. No 430,303—Scheffel, now abandoned, filed Jan. 2, 1974 (Monday after New Years).

BACKGROUND AND SUMMARY OF THE INVENTION

The present invention relates to new and improved yarn transport apparatus for weaving machines having fluid weft inserting means.

The primary object of the present invention is to provide at the insertion nozzle of a fluid weaving machine the most uniform possible infeed of the weft yarn and to optionally regulate the conveyed yarn quanity depending upon requirements.

THE DRAWINGS

In the drawings:

FIGS. 5 and 6 show features of the invention applied to a weft (filling) supply system on a pneumatic loom.

FIGS. 7 and 8 show examples of how two drums are arranged in tandem and a gap avoided.

Figure 1:
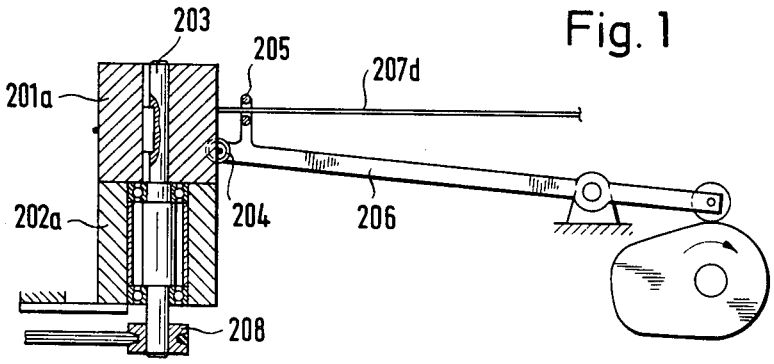
FIG. 1 is a partially sectioned elevational view of a structural embodiment in accordance with the present invention.
Figure 2:
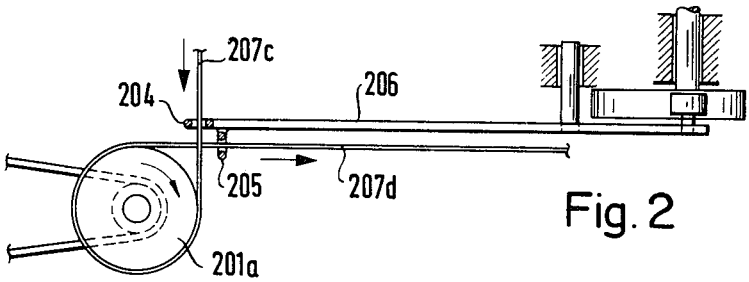
FIG. 2 is a plan view of the structural embodiment of FIG. 1.

Typical embodiments are illustrated in FIGS. 1 to 8:

FIGS. 1 and 2 show the invention in a version having two cylindrical drums 201*a* and 202*a* of equal diameters. The drum 202*a* is fixed and contains the bearing system of the shaft 203. The drum 201*a* is mounted on the shaft 203 and is caused to rotate by the drive 208 as indicated by the arrow. The drums 201*a* and 202*a* are arranged close together, but without contacting each other.

The thread 207*c* first passes through the thread guide eye 204, is then wrapped round the drum 201*a* or 202*a* with acontact angle of about 270° and runs off tangentially to enter the thread guide eye 205. The two thread guide eyes 204 and 205 are mounted on the thread guide 206 which moves up and down cyclically in synchronism with the loom so that the thread 207*c* is alternately wrapped around the drum 201*a* and the drum 202*a.* The motion of the thread guide 206 is controlled so that the loop of the thread 207*c* is taken around the drum 201*a* when the motions of the thread parts 207*c* and 207*d* are required to be assisted, and around the stationary drum 202*a* when the thread parts 207*c* and 207*d* are required to be retarded. The rotating drum 201*a* runs at a constant speed, its peripheral speed being greater than the maximum speed of the thread 207*c* and 207*d.*

Figure 3:
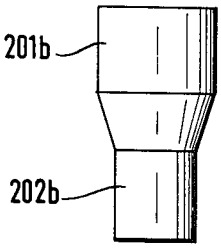
FIG. 3 and FIG. 4 show alternative drum shapes.
Figure 4:
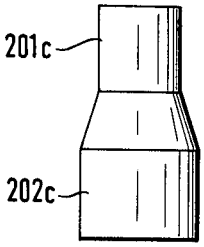

Alternative drum shapes are shown in FIGS. 3 and 4. The stationary drum 202*b* is of cylindrical shape and cooperates with the rotating drum 201*b.* This drum 201*b* has a cylindrical portion having a greater diameter than drum 202*b* and a conical section serving as a transition between two diameters. This ensures that a thread loop wrapped around the drum 201*b* or 202*b* will change its diameter as it is cyclically shifted by the thread guide 206 shown in FIG. 1 from one drum to the other (201*b,* 202*b*).

The thread loop around the drums can be looked upon as a stored supply of thread. Any change in the diameter of the thread loop is tantamount to a change in the amount of thread stored.

For instance, as the thread loop passes from drum 102*b* to drum 202*b* more thread will run off the drums for a short period than is wound on.

During the transition of the thread loop from drum 202*b* to drum 201*b,* less thread will run off as the loop diameter is increased than is wound on.

This effect can be utilized in order to influence the acceleration and deceleration of the thread 207*c* and 207*d.* Furthermore, it is advantageous for some applications to have an additional storage action operating in the system as shown in greater detail in FIGS. 5 and 6 as the thread 207*c,* 207*d* is accelerated and decelerated. Alternative diameter combinations of the drums are shown in FIGS. 5 and 6 as the thread 207*c,* 207*d* is accelerated and decelerated. Alternative diameter combinations of the drums are shown in FIGS. 3 and 4, the stationary drums 202*b* and 202*c* being combined with the rotating drums 201*b* and 201*c* respectively.

FIGS. 5 and 6 shown the invention as applied to the weft (filling) supply system on a pnuematic loom.

The thread 207*a* coming from the supply bobbin (quill) 212 passes around the traction drum 211 to be taken from there as thread 207*b* to the deflection member 209 and as thread 207*c* further to the thread guide eye 204, around the drums 201*b* and 202*b* through the thread guide eye 205 and to the picking nozzle 213.

During operation of the loom the traction drum 211 rotates at a constant speed and delivers the thread 207*a* to the deflection member 209 which moves on the track 210 in synchronism with the loom. The thread feed by the traction drum 211 and the track speed of the deflection member are matched so that the thread 207*c* in the thread guide eye 204 will become stationary whenever the deflection member 209 moves in the direction from track center 217 towards 216. As the deflection member moves again in the direction from track center 216 towards 217, the thread 207*c* in the thread guide eye 204 is again set into motion. This cycle is repeated so that thread 207*c,* 207*d* is moving as long as the shed is ready for weft insertion.

The hairpin-shaped thread length 207*b,* 207*b* formed by the deflection member 209 is paid out due to the action of the picking nozzle 213 as the pick is inserted. The force required for accelerating this thread mass is applied by the picking nozzle 213 and on the drums 201*b* and 202*b.* let the force applied by the picking nozzle to be the thread 207*d* be $S_1$, then the force in the thread part 207*c* is $S_2 = S_1 e\mu\alpha$ where $e = 2.71$ and $\mu =$ friction coefficient between thread 207*c* and drum 201*b* and $\alpha$ the contact angle of the thread 207*c* on the drums 201*b* and 202*b* respectively.

The movement of the thread guide 206 is so controlled that the thread loop between the thread guide eyes 204 and 205 is placed round the rotating drum 201*b* as long as the deflection member 209 is moving in the direction from the track center 216 and 217. During this phase, the thread 207*d* is inserted into the shed 215. As the deflection member enters its semi-circular path about the deflection or track center 217, this causes the thread 207*c,* 207*d* decelerate, and from this results an additional inertia force $S_3$ acting on thread 207*b.* In order to prevent this force $S_2$ from acting on thread 207*c* and causing excessively high stresses there, the thread guide 206 is controlled in time as deceleration commences so as to place the loop of thread 207*c,* 207*d* around the stationary drum 202*b.* Before the deflection member 209 on its path from 217 towards 216 enters again into the semi-circular curve about 216, the thread guide 206 will return the loop formed by thread 207*c*, 207*d* onto the rotating drum 210*b*.

The design of the drums 201*b* and 202*b* with differing diameters affords an additional advantage in connecting with the cutting of the thread 207*d* by means of the scissors 214 which takes place after every pick when the thread is stationary. During cutting of the thread, the loop formed by thread 207*c*, 207*d* is placed around the stationary drum 202*b* which has a smaller diameter than the rotating drum 210*b*. Since the transition of the thread loop from drum 202*b* to drum 201*b* is effected while the thread 207*c* is at a standstill, the increase of the loop causes the end of the thread 207*d* to be retracted from the scissors. This is desirable, because the end of thread 207*d* is thereby prevented from catching in the scissors 214 or other adjacent parts before the next pick is effected under the influence of the current from nozzle 213.

FIGS. 7 and 8 show examples of how the two drums 201*a*, 201*b* 201*c*, 201*d* and 202*a*, 202*b*, 202*c* 202*d* respectively can be arranged in tandem and a gap avoided.

What we claim is:

1. Apparatus for the insertion of a weft thread in the shed of warp threads in a weaving machine having means to propel and decelerate the weft and a weft supply arranged outside the shed in which the weft is alternately guided around a rotating drum and a coaxial stationary drum in which a thread guide is movable in the axial direction of at least two coaxial drums arranged close together and in which at least one of the drums is imparted a constant rotation by a drive.

2. Apparatus as in claim 1 in which the rotating drum and the stationary drum are of equal diameter.

3. Apparatus as in claim 1 in which the rotating drum and the stationary drum are of different diameters.

4. Apparatus as in claim 3 in which the said drums with said thread guide and a guide track and openings forming picking nozzles are associated with a pneumatic weaving machine.

5. Apparatus as in claim 1 in which the transition between said drums of differing diameters is in the form of a cone and in which this cone is constructed as a rotating member or a stationary member.

* * * * *